US006781604B2

(12) United States Patent
Poynter

(10) Patent No.: US 6,781,604 B2
(45) Date of Patent: Aug. 24, 2004

(54) METHODS AND APPARATUS FOR ANALYZING AND ORIENTING LCD VIEWING SCREENS IN ORDER TO PROVIDE IMPROVED DISPLAY QUALITY

(75) Inventor: William Douglas Poynter, Duluth, GA (US)

(73) Assignee: NCR Corporation, Dayton, OH (US)

( * ) Notice: Subject to any disclaimer, the term of this patent is extended or adjusted under 35 U.S.C. 154(b) by 370 days.

(21) Appl. No.: 10/036,812

(22) Filed: Dec. 21, 2001

(65) Prior Publication Data

US 2003/0117418 A1 Jun. 26, 2003

(51) Int. Cl.[7] ..... G09G 5/10
(52) U.S. Cl. ..... 345/690; 345/659
(58) Field of Search ..... 345/619, 649, 345/659, 690; 361/681, 683

(56) References Cited

U.S. PATENT DOCUMENTS 5,329,289 A * 7/1994 Sakamoto et al. ..... 345/659
5,941,618 A * 8/1999 Cheng ..... 312/223.2
5,971,268 A * 10/1999 Lynch et al. ..... 235/1 R
5,973,664 A * 10/1999 Badger ..... 345/659
5,986,634 A * 11/1999 Alioshin et al. ..... 345/649
6,407,909 B1 * 6/2002 Kato et al. ..... 361/681
6,441,828 B1 * 8/2002 Oba et al. ..... 345/659

FOREIGN PATENT DOCUMENTS

JP 404350787 * 12/1992

* cited by examiner

*Primary Examiner*—Regina Liang
(74) *Attorney, Agent, or Firm*—Priest & Goldstein, PLLC; Paul W. Martin

(57) ABSTRACT

Techniques for installing and orienting liquid crystal display screens in terminals so as to provide improved visual quality and readability are disclosed. A suitable screen is chosen for a terminal and installed in the terminal in an orientation which will provide superior display quality from the perspective of an intended user. The screen may be installed in an orientation rotated 90 or 180 degrees from the expected orientation for which it was designed by the manufacturer. In order to provide a correctly oriented display, display adjustment software rotates the display appropriately in order to compensate for the rotation of the screen so that the information displayed on the screen is correctly oriented.

14 Claims, 8 Drawing Sheets

METHODS AND APPARATUS FOR ANALYZING AND ORIENTING LCD VIEWING SCREENS IN ORDER TO PROVIDE IMPROVED DISPLAY QUALITY

FIELD OF THE INVENTION

The present invention relates generally to improving the quality of the display provided by a liquid crystal display (LCD) screen. More particularly, the invention relates to techniques for analyzing and orienting display screens for their intended use in an actual product environment so as to provide a good visual quality for an observer viewing the screen at an expected angle when the product is in normal use.

BACKGROUND OF THE INVENTION

Liquid crystal display screens are used in many applications and provide significant advantages such as thinness, low power consumption and low heat generation. They are frequently used in point of sale systems, in which efficient use of space and power is often highly beneficial. One notable characteristic of LCD display screens, which often introduces difficulties with their use, is that many characteristics influencing the quality of the display produced by a screen are highly dependent on the perspective of the observer with respect to the screen. A number of characteristics influence display quality, however, several are particularly important. Among the more important characteristics are luminance, that is, the physical correlate of perceived brightness, luminance contrast and color contrast. Moreover, these characteristics are highly dependent on the perspective of the observer. If a display as viewed from an observer's perspective provides high luminance, high luminance contrast and high color contrast, the display tends to have high levels of legibility and image clarity when viewed from that perspective.

The perspective of the observer may suitably be described in terms of a skew angle and a roll angle. The skew angle is the angle between the observer's line of sight to the screen and the normal vector, which is a vector perpendicular to the surface of the screen and extending out of the screen. The roll angle describes the orientation of the screen with respect to an observer looking in at the screen from the edge of the screen, and with the orientation being confined to the plane of the screen. For example, for a particular frame of reference, a roll angle of zero degrees, or 12 o'clock, may describe an orientation of the screen such that an observer is looking straight down at the edge of the screen from the top. A roll angle of 90 degrees, or 3 o'clock, would describe an orientation of the screen such that an observer is looking at the edge of the screen from the right side. A roll angle of 180 degrees, or 6 o'clock, would describe an orientation of the screen such that an observer is looking at the edge of the screen from the bottom, and a roll angle of 270 degrees, or 9 o'clock, would describe an orientation of the screen such that an observer is looking at the edge of the screen from the left side.

As noted above, luminance and contrast vary significantly with the perspective of the observer. This variation makes useful a concept called threshold viewing angle. Threshold viewing angle is the largest skew angle for a given roll angle at which a display is considered readable. For example, suppose an observer is looking downward at a display at a roll angle of 0 degrees, or 12 o'clock. In such a case, an exemplary display may provide acceptable image quality through a range of skew angles from 0 to 25 degrees. The threshold viewing angle at a 0 degree roll angle would therefore be 25 degrees. If the skew angle component of the line of sight of the observer is between 0 degrees and this threshold skew angle, the luminance contrast and brightness will be such that the display is legible. If the observer moves so that his or her line of sight falls outside of this threshold angle, the display will be unreadable because of poor luminance contrast and brightness.

Devices employing LCD screens are typically designed and built using standardized LCD screens which are manufactured by vendors and supplied to purchasers and incorporated into the devices designed by the purchasers. A purchaser typically selects a screen from among those offered by the manufacturer, rather than ordering a screen designed to the purchaser's specifications, because it is not economical for a manufacturer to design a screen to order unless the quantity ordered is very great. Frequently, available LCD screens provide relatively poor display quality when an observer looks downward at the screen, that is, at a relatively large skew angle at a 12 o'clock roll angle, or upward at the screen, that is, at a relatively large skew angle at a 6 o'clock roll angle, compared to looking from the left or right, that is, at a large skew angle at a 9 or 3 o'clock roll angle. These differences in visual quality are related to differences in luminance contrast and brightness. Moreover, there are typically differences in quality between upward and downward viewing angles. Which orientation is better depends to some degree on the photometric characteristics of the displayed images at 0 degrees skew angle. Text screens composed of black lettering on a white background will often look better at 6 o'clock than at 12 o'clock because the luminance contrast is typically better at 6 o'clock. On the other hand, very dark images might look worse at 6 o'clock because image brightness is often substantially reduced at these angles.

In a point of sale terminal designed for a standing user for example, the user looks downward at the display. As noted above, however, many LCD screens supplied by manufacturers are designed such that the screen provides a relatively poor visual quality, and a reduced threshold viewing angle, for an observer looking downward at the screen. It is possible to design a terminal having the screen tilted upward so that the observer views the screen at a reduced skew angle, that is, at an angle more nearly normal to the screen, so that the detrimental effect of the reduced threshold viewing angle is reduced. However, in the commonly encountered situation in which lights are mounted in the ceiling of a room so that the ambient light emanates from above, angling the screen upward contributes to glare and decreases readability.

There exists therefore, a need for techniques for incorporating an LCD screen into devices which will allow the screen to be oriented in such a way as to provide the maximum possible display quality for the perspective from which the screen is most likely to be viewed.

SUMMARY OF THE INVENTION

According to one aspect, the present invention comprises a point of sale terminal including an LCD screen oriented so as to provide an improved display quality and threshold viewing angle for an observer looking downward at the screen. The point of sale terminal may suitably employ a standard LCD screen which provides an improved display quality to an observer looking upward at the screen when the screen is mounted in a conventional configuration. In order to provide a superior display quality for an observer looking downward, the screen is mounted in an orientation rotated 180 degrees from the conventional configuration. In order to prevent the displayed material from being presented upside down, display adjustment software is used to rotate the displayed material 180 degrees. The rotation of the display on the screen, combined with the physical rotation of the screen, causes the display to be correctly presented to an observer. The display adjustment software may be permanently resident, for example in ROM, or may be loaded automatically at initialization of the terminal.

An alternative embodiment of the present invention comprises a point of sale terminal including an LCD screen oriented so as to provide an improved display quality and threshold viewing angle for an observer looking downward at the screen, and employing an LCD screen which provides an improved display for an observer viewing from the left or right of the screen, that is, at a 9 or 3 o'clock roll angle, when the screen is mounted in its conventional configuration. In this embodiment, the screen is mounted in a configuration rotated 90 degrees left or right from the conventional configuration and display adjustment software is used to rotate the displayed material 90 degrees left or right, as required, so that the display is correctly presented to an observer.

A more complete understanding of the present invention, as well as further features and advantages of the invention, will be apparent from the following Detailed Description and the accompanying drawings.

DETAILED DESCRIPTION

Figure 1:
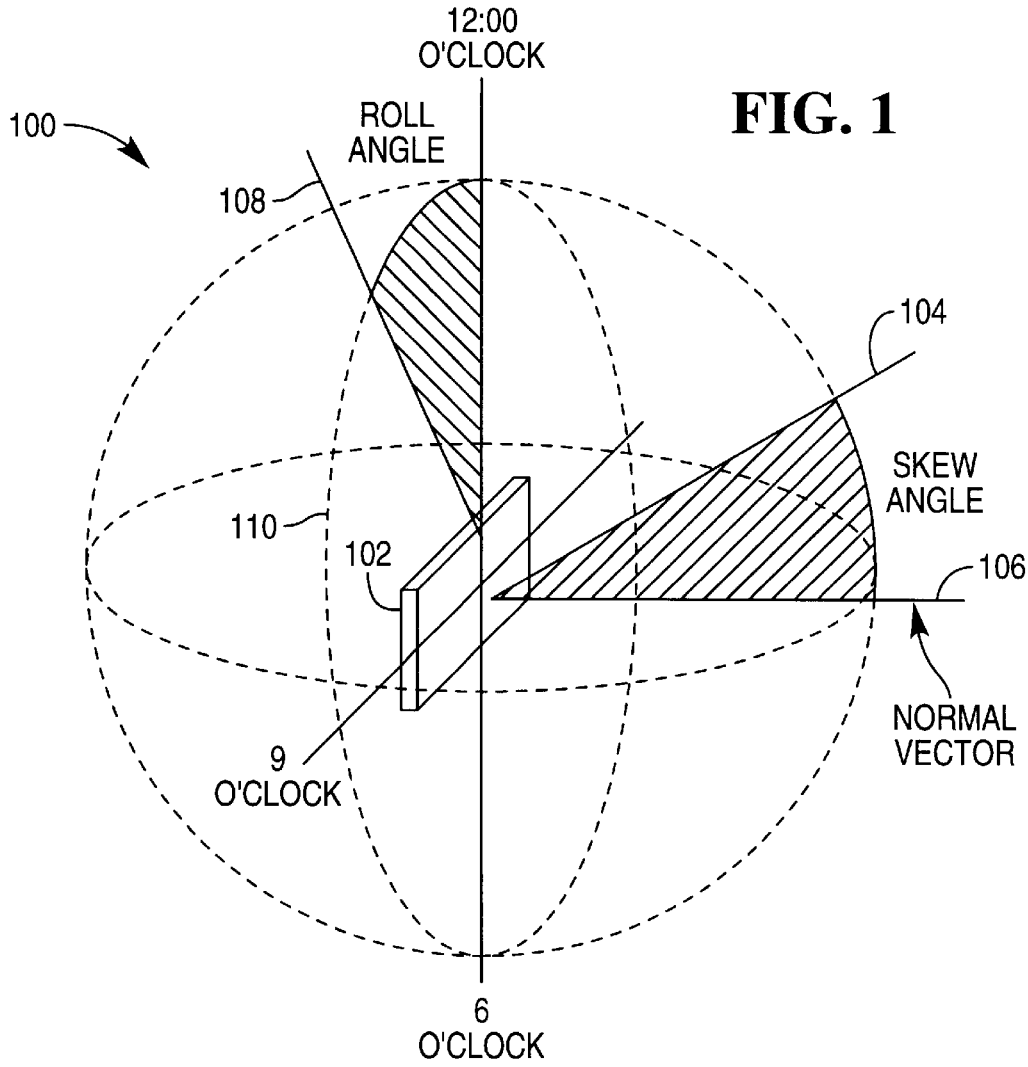
FIG. 1 illustrates a frame of reference for describing the orientation of an LCD screen and an observer's angle of view and their effect on display quality.

FIG. 1 illustrates a frame of reference 100 having an LCD screen 102 located at the center thereof. The orientation of the LCD screen 102 with respect to an observer may suitably be described in terms of two angles. The first angle may be referred to as a skew angle, which defines the angle of an observer's line of sight to the screen 102. The skew angle is an angle between the line of sight 104 of the observer, and the normal vector 106, which is a vector perpendicular to the screen 102. The second angle may be referred to as a roll angle, which describes an observer's line of sight 108 looking inward at the screen 102 as the line of sight 108 rotates through a plane 110 parallel to the screen 102, with the screen placed in its expected orientation as it was designed by the manufacturer. The plane 108 may be compared to the face of a clock and the observer's line of sight to the screen 102 may be compared to the hour hand of a clock. A roll angle of 0 degrees or 12 o'clock would thus be a vertical line of sight looking straight down at the screen 102 in the plane 108. A roll angle of 90 degrees or 3 o'clock would be a line of sight looking straight at the screen from the right. A roll angle of 180 degrees or 6 o'clock would be a line of sight looking straight up at the screen, and a roll angle of 270 degrees or 9 o'clock would be a line of sight looking straight at the screen from the left. Defining the skew angle and roll angle of an observer's line of sight to the screen 102 defines the perspective of the observer with respect to the screen 102.

Figure 2:
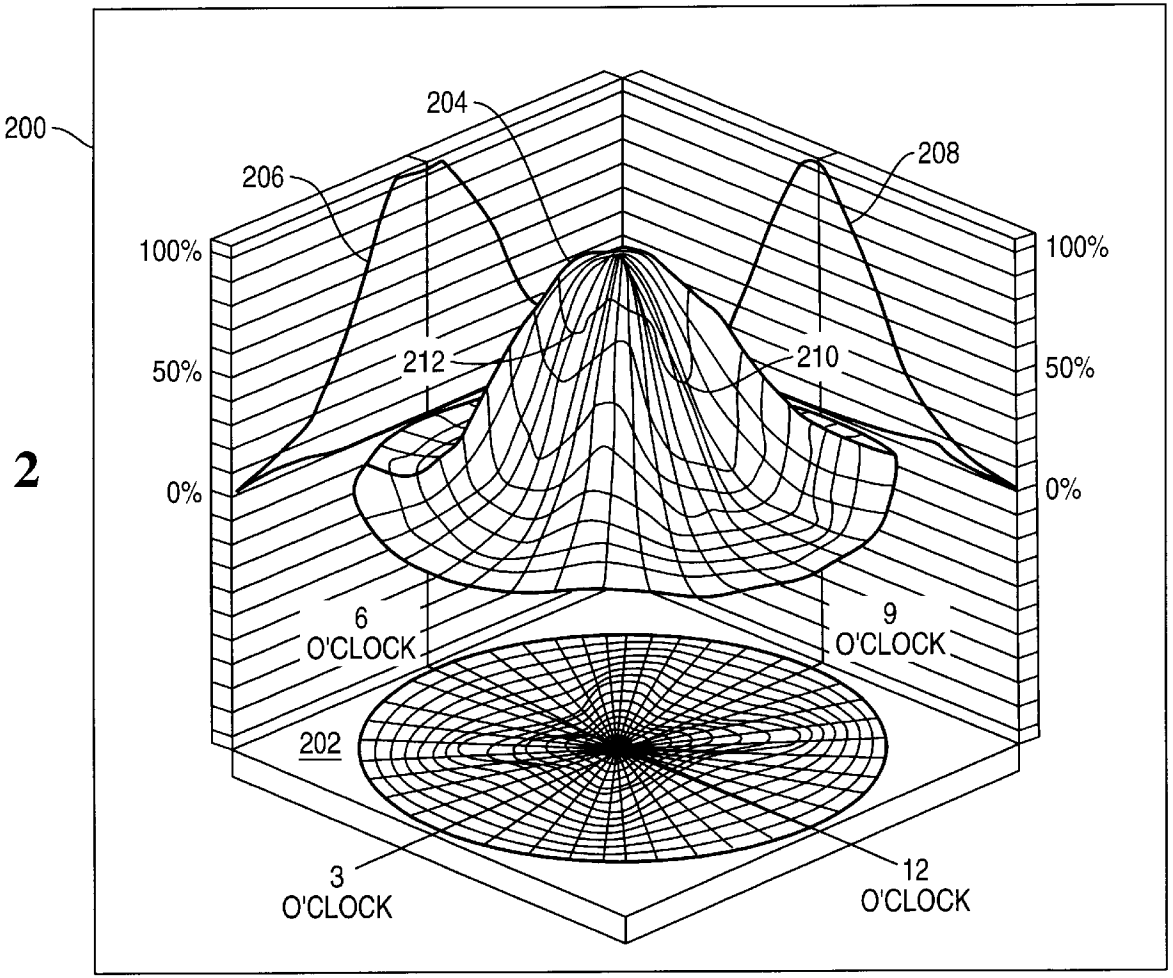
FIG. 2 illustrates the relationship between contrast and a combination of roll angle and skew angle for a representative sampling of LCD screens.

FIG. 2 presents a graph 200 illustrating the relationship between contrast and observer viewpoint for a representative LCD screen 202. The observer viewpoint is defined in terms of a combination of roll angle and skew angle. The graph 200 includes a 3 dimensional contour 204 in which contrast is represented as a value between 0 and 100% of the maximum contrast value for each of a plurality of observer viewpoints. The graph 200 also presents a horizontal cross section 206, that is, a cross section at 3 o'clock and 9 o'clock roll angles, of the contour 204 and a vertical cross section 208, that is, a cross section at 12 o'clock and 6 o'clock roll angles, of the contour 204. The first curve 206 narrows more slowly toward the peak than does the second curve 208. This illustrates the fact that the roll angles of 3 o'clock and 9 o'clock provide higher contrast over a wider range of skew angles than do the roll angles of 6 o'clock and 12 o'clock. This is further instantiated by the contour 204. For example, the point 212 on the contour 204 represents the contrast at a 3 o'clock roll angle and a 10 degree skew angle. It can be seen that the point 212 is much higher than is the point 210, which represents the contrast at a 12 o'clock roll angle and a 10 degree skew angle. That is, the point 212 represents a higher contrast value than does the point 210.

Figure 3:
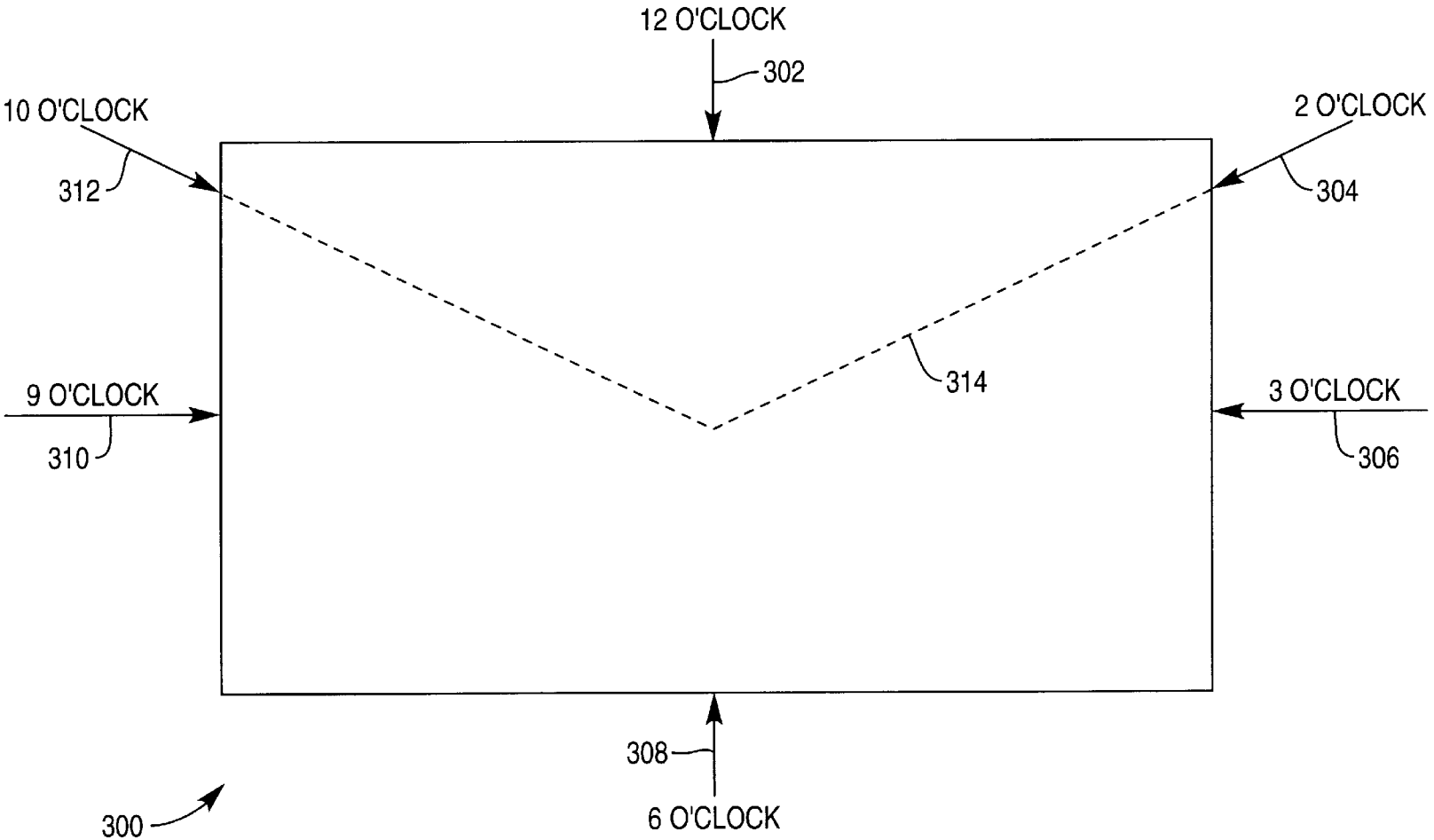
FIG. 3 illustrates an exemplary LCD screen illustrating typical roll angles at which viewing may occur in a point of sale environment.

FIG. 3 illustrates a front view of an LCD screen 300, illustrating various roll angles and showing a particular range of roll angles at which the screen 300 may be expected to be viewed in a typical point of sale environment. The roll angles 12 o'clock, 2 o'clock, 3 o'clock 6 o'clock, 9 o'clock and 10 o'clock are represented by the arrows 302–312, respectively. In a typical point of sale environment, ergonomic positioning of the screen often results in the user looking at a screen such as the screen 300 in a downward direction. That is, the user looks at the screen most often between the roll angles of 2 o'clock and 10 o'clock. The dashed line 314 represents a projection of the arrows 304 and 312 toward the center of the screen 300, in order to better illustrate the typical range of roll angles.

As noted above, in many cases such a range of viewing angles provides the poorest contrast. This is particularly true if a thin film transistor active matrix (TFT) screen is used as the screen 300. TFT screens are popular and widely used because they typically provide better display quality than other screens in common use such as double-layer supertwist nematic (DSTN) screens. If the screen 300 is used in its expected orientation as designed by the manufacturer, it will provide a narrower range of acceptable viewing angles for a user looking downward at the screen than if it were reoriented to provide a better contrast.

Figure 4:
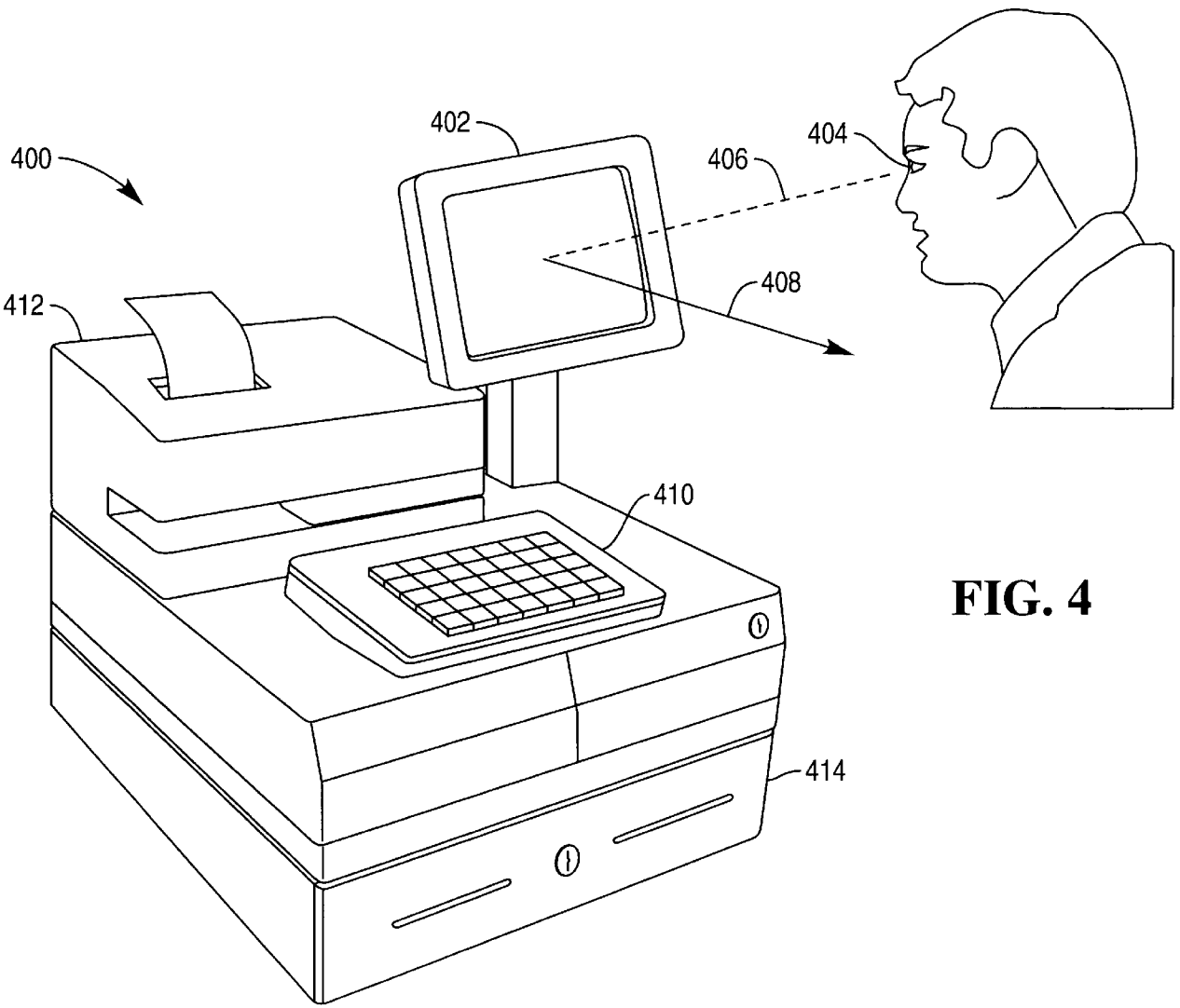
FIG. 4 illustrates a point of sale terminal employing an LCD screen oriented according to an aspect of the present invention.

FIG. 4 illustrates a point of sale terminal 400 employing an LCD screen 402 according to the present invention. The terminal 400 is adapted for use by a standing operator having a point of view at the location 404. The screen 402 is positioned and oriented such that the operator having the point of view 404 looks at the screen 402 in a downward direction in order to view it. That is, the line of sight 406 from the location 404 makes a positive angle with the normal vector 408 and therefore has a positive skew angle. The terminal 400 also includes a keyboard 410, receipt printer 412 and cash drawer 414.

The exemplary terminal 400 shown here employs the LCD screen 402, which may suitably be a TFT active matrix screen. The LCD screen 402 is mounted in a "landscape" orientation, that is, an orientation such that the width of the screen 402 is greater than its height. The LCD screen 402 is oriented in such a way that the visual quality of the display provided to an observer looking downward at the screen is as good as can be achieved given the desire to use a "landscape" orientation. For the typical TFT screen, better visual quality can sometimes be achieved, depending to some degree on the photometric characteristics of the graphics and text being displayed, by mounting screen 402 upside down with respect to the mounting for which it was designed by the manufacturer. The presentation and orientation of the typical display is controlled by standardized software provided by the manufacturer of the display or by the manufacturer of a video card. This software orients the displayed information correctly, provided that the screen is oriented in the mounting for which it was designed by the manufacturer. If the screen 402 is mounted upside down with respect to the orientation for which it is designed by the manufacturer, it is necessary to adjust video information before sending it to the standardized software used to control the display, in order to prevent the display from appearing upside down.

Figure 5:
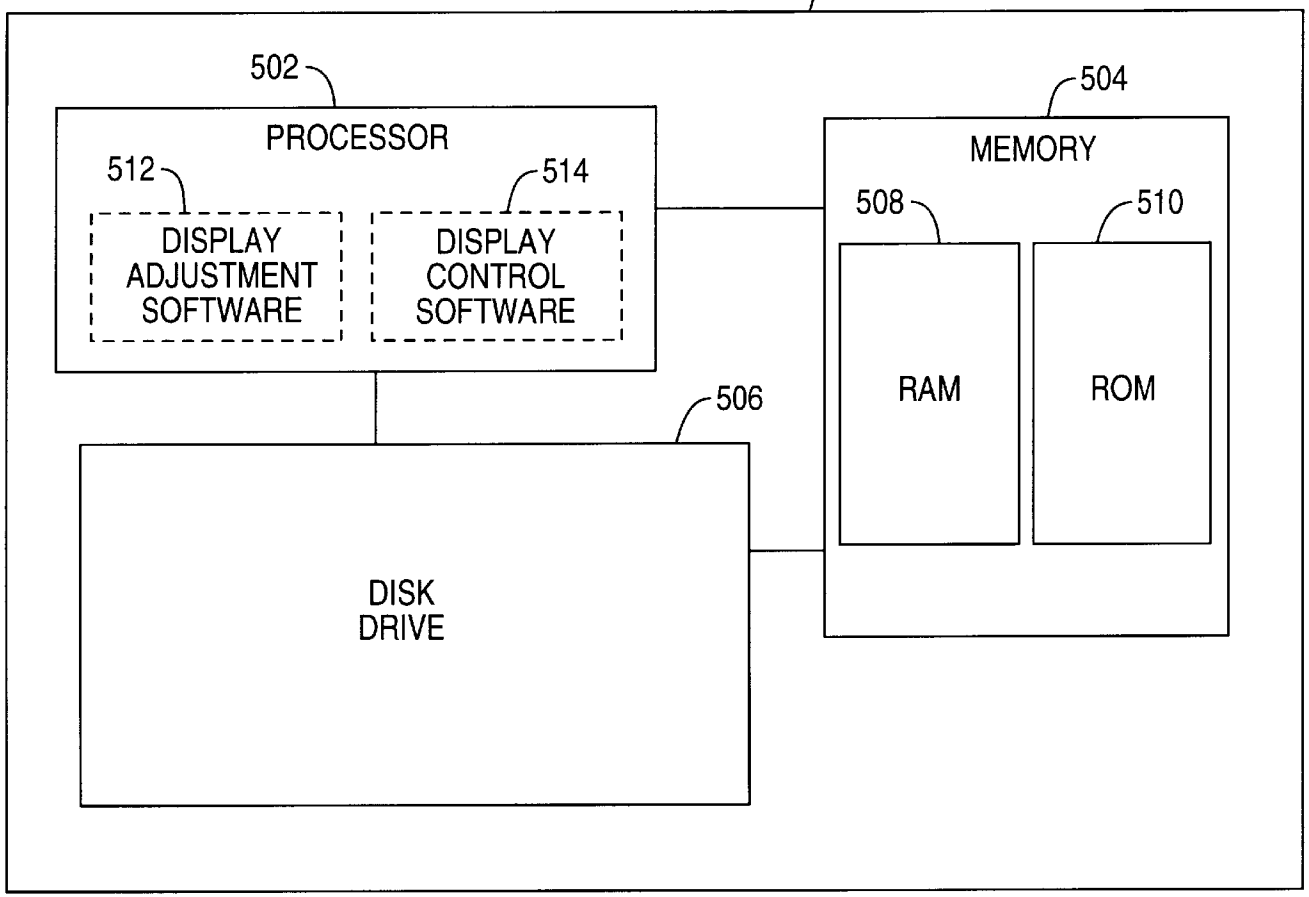
FIG. 5 illustrates a diagram of various internal components of the terminal of FIG. 4.

FIG. 5 is a diagram showing various interior components of the terminal 400, used to process data for the operation of the terminal 400 and the display provided by the screen 402. The terminal 400 includes a processor 502, memory 504 and disk drive 506. The memory 504 may suitably include RAM 508 for temporary storage of programs and data and ROM 510 for relatively permanent storage of operating instructions and parameters.

In order to prevent the text and graphics displayed on the screen 402 from being displayed upside down, appropriate display adjustment software 512 is executed by the processor 502. The display adjustment software 512 may suitably reside on the disk drive 506 and be loaded into the RAM 508 whenever the terminal 400 is started. The software 512 remains resident in the RAM 510 during operation of the terminal 400 and is used by the processor 502 to make suitable adjustments for each point to be displayed on the screen 402. Alternatively, the software 512 may reside permanently in the ROM 510, where it can be similarly used to make appropriate adjustments. The display adjustment software 512 corrects the orientation of the visual data to be displayed before presenting it to the standard display software.

The software 512 receives each data point intended for display and rotates it around the center of the screen so that the display appears upside down on the screen 402. Because the screen 402 is itself upside down with respect to its expected orientation, the processing performed by the software 512 therefore causes the display to appear right side up on the screen 402 as it is actually installed in the terminal 400.

In the present case, each point on the screen 402 can be located by an (X,Y) coordinate, where X expresses the number of columns from the left of the screen and Y expresses the number of rows from the top of the screen. The (0,0) position is the top left corner of the screen 402. The display adjustment software 512 first calculates the center position of the screen 402 using the following equations:

$$centerX = Screenwidth/2$$

$$centerY = Screenheight/2,$$

where Screenheight and Screenwidth are the number of rows on the screen 402 and the number of columns on the screen 402, respectively.

For each point on the screen 402, the display adjustment software 512 creates a new set of coordinates rotated from the original coordinates by 180 degrees around the center of the screen 402. First, the display software 512 calculates the current (X,Y) coordinates relative to the center of the screen 402 using the following equations:

$$relativeX = currentX - centerX$$

$$relativeY = centerY - currentY$$

Next, the display adjustment software 512 creates a new relative position rotated through 180 degrees, using the following equations:

$$newrelativeX = relativeX * \mathrm{Cos}(180) - relativeY * \mathrm{Sin}(180)$$

$$newrelativeY = relativeX * \mathrm{Sin}(180) + relativeY * \mathrm{Cos}(180)$$

Finally, the display adjustment software 512 creates new coordinates of the rotated point relative to the top left, or (0,0) position of the screen using the following equations:

$$newcurrentX = newrelativeX + centerX$$

$$newcurrentY = centerY - newrelativeY$$

After adjusted coordinates are created for each point on the screen, the display adjustment software 512 supplies the values of each point, along with the adjusted coordinates, to display control software 514 used to control the display. The display control software 514 receives the adjusted coordinates of each point and its accompanying values and creates a display having the properties defined by the accompanying values at each point.

Figure 6:
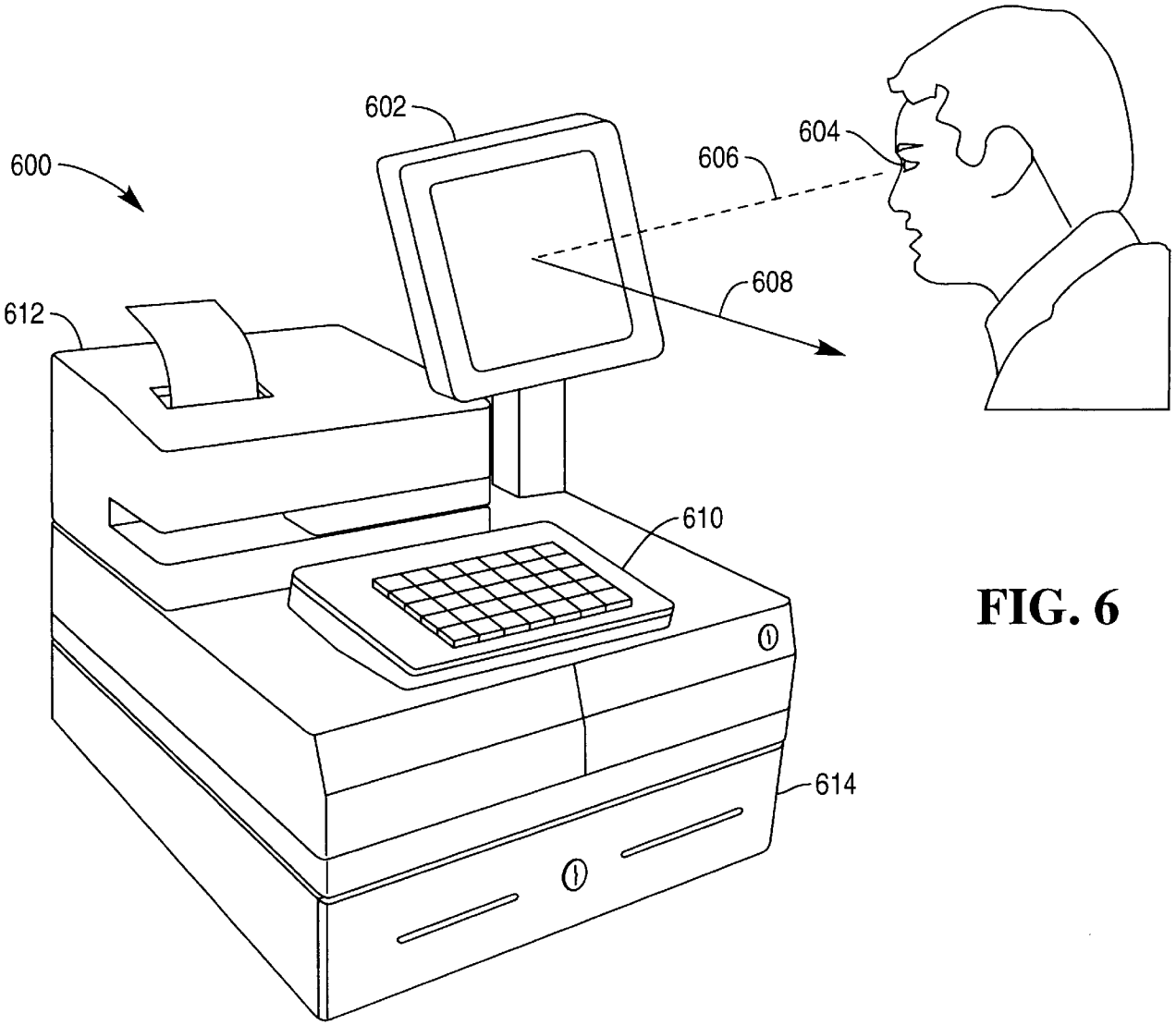
FIG. 6 illustrates a point of sale terminal employing an LCD screen oriented according to an alternative aspect of the present invention.

FIG. 6 illustrates an alternative terminal 600 employing an LCD screen 602 installed and configured according to the present invention. The terminal 600 is adapted for use by a standing operator having a point of view at the location 604, and the screen 602 is installed in such a way that the operator having the point of view 604 looks down at the screen 602. The operator's line of sight 606 makes a positive angle with the normal vector 608. The terminal 600 also includes a keyboard 610, receipt printer 612 and cash drawer 614. The screen 602 may suitably be a standard rectangular screen available from a manufacturer, designed by the manufacturer to be installed and used in a landscape orientation. The screen 602 employed here, however, is installed in a portrait configuration, so that the height of the screen as installed is greater than the width. In order to achieve this orientation, the screen 602 is rotated 90 degrees, positive or negative, as desired, from the orientation contemplated by the manufacturer. This orientation takes advantage of the fact that the visual quality of the display, most notably the luminance, contrast and resulting threshold viewing angle, is frequently superior when an LCD screen is viewed from either side than when it is viewed from above or below. This is often true of both TFT and DSTN screens.

As is the case with the terminal 400 and the screen 402 discussed above, the display presented using the screen 602 is controlled by standardized software designed to present a correct display given the expected orientation of the screen 602 as it was designed by the manufacturer. If the screen 602 is rotated with respect to the orientation for which it is designed by the manufacturer, it is necessary to adjust video information before sending it to the standardized software used to control the display, in order to prevent the display from appearing upside down.

Figure 7:
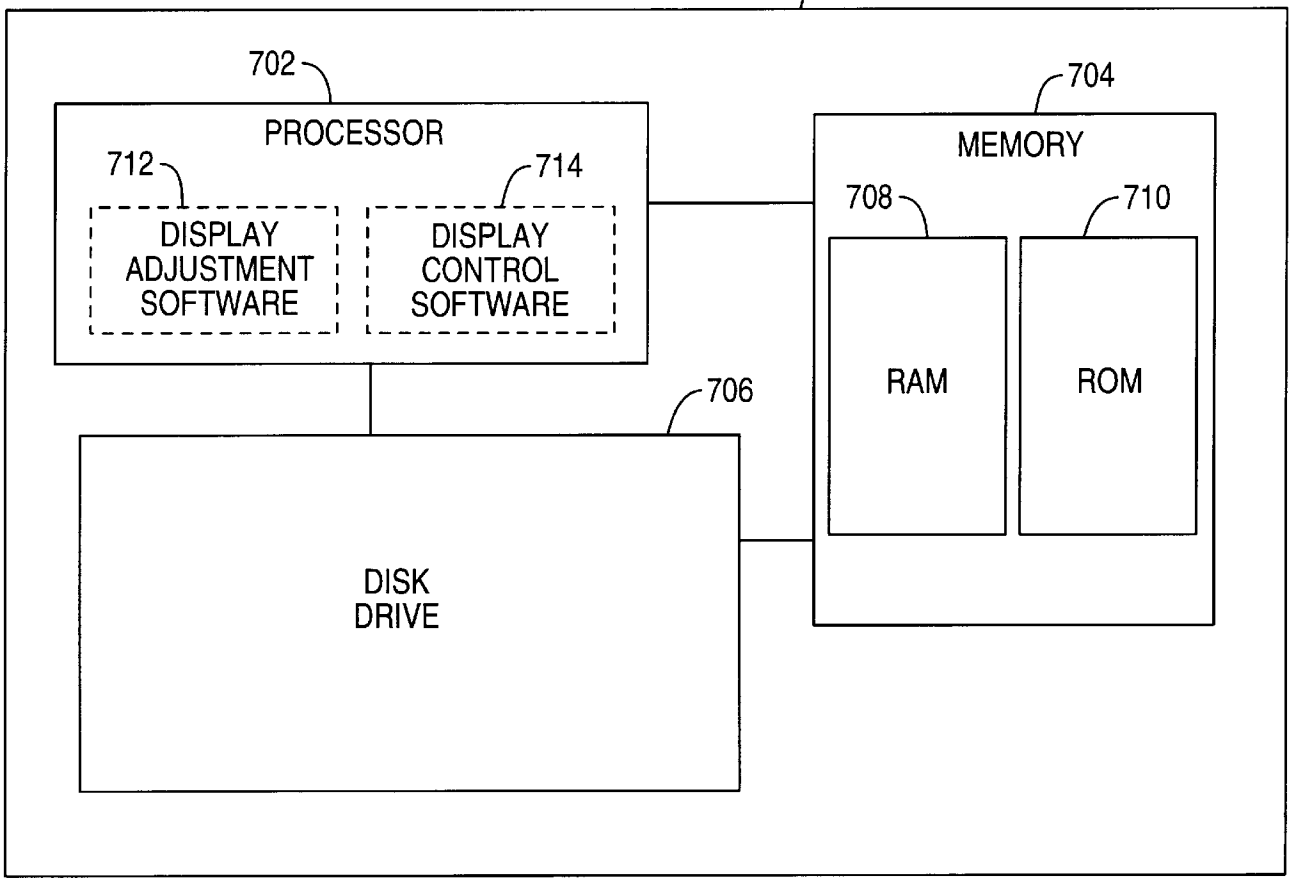
FIG. 7 illustrates a diagram of various internal components of the terminal of FIG. 5.

FIG. 7 illustrates a diagram of various components employed in the terminal 600. The terminal 600 includes a processor 702, memory 704 and disk drive 706, and the memory 704 includes RAM 708 and ROM 710. The processor 702 executes display adjustment software 712 in order to correct the display so that it has a proper orientation as presented on the screen 602.

The software 712 may be similar to the software 512, with the only difference being suitable changes to parameters in order to rotate the text and graphics 90 degrees instead of 180 degrees. Specifically, the new relative positions of the (X,Y) coordinates are created using the following equations:

$$\text{newrelative}X=\text{relative}X*\text{Cos}(90)-\text{relative}Y*\text{Sin}(90)$$

$$\text{newrelative}Y=\text{relative}X*\text{Sin}(90)+\text{relative}Y*\text{Cos}(90)$$

The software 712 may reside in the memory 704 in the same way that the software 512 of FIG. 5 resides in the memory 504, and it will be recognized that any number of techniques may be used for storing and implementing the software 712 for use by the processor 702. After adjusted coordinates are created for each point on the screen, the display adjustment software 712 supplies the values of each point, along with the adjusted coordinates, to display control software 714 used to control the display. The display control software 714 receives the adjusted coordinates of each point and its accompanying values and creates a display having the properties defined by the accompanying values at each point.

While the screen 602 is discussed here as having been rotated 90 degrees from its expected orientation as designed by the manufacturer, it will be recognized that the terminal 600 may alternatively be designed with the screen rotated 270 degrees from its expected orientation. In that case, the display adjustment software 712 would be changed so that the new relative position of each point was given by the following equations:

$$\text{newrelative}X=\text{relative}X*\text{Cos}(\mathbf{270})-\text{relative}Y*\text{Sin}(\mathbf{270})$$

$$\text{newrelative}Y=\text{relative}X*\text{Sin}(\mathbf{270})+\text{relative}Y*\text{Cos}(\mathbf{270}).$$

Figure 8:
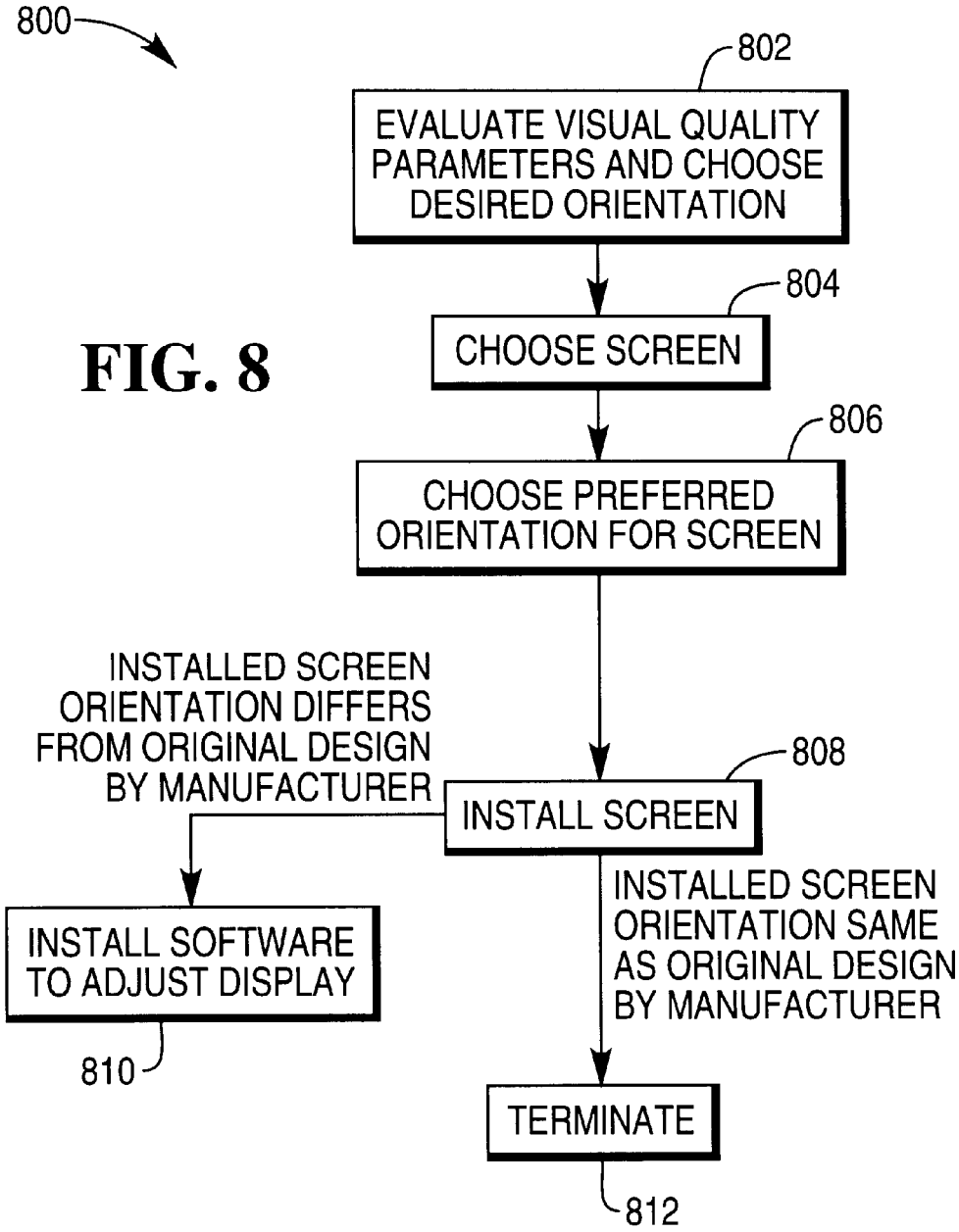
FIG. 8 illustrates a process of LCD screen analysis and point of sale design according to the present invention.

FIG. 8 illustrates a process of LCD screen analysis and terminal design 800 according to the present invention. At step 802, parameters affecting display quality, including luminance, contrast and color are evaluated for an LCD screen which it is desired to incorporate into a terminal, or alternatively for each of a plurality of LCD screens which are candidates for incorporation into a terminal. The parameters are evaluated for each of various viewing angles.

At step 804, a screen is chosen for incorporation into the terminal based on the evaluation of the visual quality parameters as well as other characteristics of the available screens in light of the desired characteristics of the terminal. At step 806, a preferred orientation is chosen for an LCD screen which has been chosen for incorporation into a terminal. The preferred orientation is the orientation which provides the best display quality given the characteristics of the information content to be displayed on the screen, and the other requirements for positioning and orientation. These include, for example, a need to install a screen at a particular height to enable accessibility for disabled users in wheelchairs, or to choose a landscape rather than a portrait orientation or vice versa because of the nature of the displayed information content.

For example, if a display having landscape dimensions is desired, the screen must be oriented so that the horizontal dimension is greater than the vertical dimension, even if a better display quality would be achieved by a portrait orientation. In cases in which an operator is looking down at the screen, a superior display quality is frequently provided if the screen is oriented in a rotation 180 degrees from the orientation for which it was designed by the manufacturer, and a still better display quality is often provided if the screen is oriented in a rotation 90 degrees from the orientation for which it was designed by the manufacturer.

Moreover, a 90 degree rotation might be particularly advantageous for some applications, for example, automated teller machines (ATM's). Such a rotation might provide a wider range of vertical viewing angles, that is, looking up or down at the display, and a relatively narrow range of horizontal viewing angles, that is, looking at the display from the left and right. For ATM's, a wider range of vertical viewing angles is advantageous because viewers may vary in height. A narrower range of horizontal viewing angles is advantageous in the case of automated teller machines because it provides a relatively high visual quality for the user of the ATM, but provides relatively poor visibility to nearby observers, thereby improving visual privacy for the ATM user.

The chosen orientation depends on the overall demands of the particular application. For example, if a screen was designed for a horizontal orientation and it is desired to use this screen in a landscape orientation, the screen cannot be oriented 90 degrees from the orientation for which it was originally designed, but may be oriented 180 degrees from the orientation for which it was originally designed, if such an orientation provides improved visual quality.

At step 808, the screen is installed in the terminal in its preferred orientation. If the orientation in which the screen is installed is different from that for which it was designed by the manufacturer, the process proceeds to step 810; otherwise, the process terminates at step 812. At step 810, software is installed in the terminal to adjust the display to compensate for any difference between the orientation of the screen as installed and the orientation for which the screen was designed by the manufacturer. The process then terminates at step 812.

While the present invention is disclosed in the context of a presently preferred embodiment, it will be recognized that a wide variety of implementations may be employed by persons of ordinary skill in the art consistent with the above discussion and the claims which follow below.

I claim:

1. A point of sale terminal comprising:

a liquid crystal display screen for displaying information, the screen being installed in the point of sale terminal in an orientation rotated from an expected orientation for which the screen was designed;

a processor for assembling and formatting information into an information display for display by the screen; and display adjustment software executed by the processor for adjusting the information display to compensate for the orientation of the screen so that the information display is presented in a normal orientation;

wherein the screen is installed in an orientation which maximizes brightness of the information display for an orientation of the screen providing a desired ratio of horizontal and vertical dimensions.

2. The terminal of claim 1 wherein the screen is installed in an orientation which maximizes contrast of the information display from a point of view of a user of the terminal.

3. The terminal of claim 1 wherein the screen is installed in an orientation which maximizes brightness of the information display from a point of view of a user of the terminal.

4. The terminal of claim 1 wherein the screen is installed in an orientation which maximizes contrast of the information display for an orientation of the screen providing a desired ratio of horizontal and vertical dimensions.

5. The terminal of claim 1 wherein the screen is installed in an orientation rotated 180 degrees from the expected orientation for which the screen was designed.

6. The terminal of claim 5 wherein the screen is installed in an orientation rotated 90 degrees from the expected orientation for which the screen was designed.

7. The terminal of claim 6 wherein the terminal includes a disk drive and wherein the display adjustment software is loaded into memory when the terminal is started.

8. The terminal of claim 6 wherein the display adjustment software is stored in read only memory within the terminal.

9. A method of terminal design comprising the steps of:

selecting a desired ratio of horizontal to vertical dimensions for a screen for use in the terminal;

performing a display quality evaluation for each of a plurality of liquid crystal display screens which are candidates for use in a terminal, evaluation being conducted from each of a plurality of observer perspectives;

selecting a screen for use in the terminal;

selecting a preferred orientation for the screen which provide the desired ratio of horizontal to vertical dimensions and which will maximize one or more desired visual characteristics of a display presented by the screen from a perspective of a user of the terminal;

installing the screen in the preferred orientation; and if the preferred orientation is different from an expected orientation for which the screen was designed, installing display adjustment software in the terminal to adjust a display presented by the screen so that the display will have a normal orientation for a user of the terminal.

10. The method of claim 9 wherein the preferred orientation is chosen to maximize contrast of the display.

11. The method of claim 9 wherein the preferred orientation is chosen to maximize brightness of the display.

12. The method of claim 10 wherein the preferred orientation is 180 degrees from the expected orientation for which the screen was designed.

13. The method of claim 10 wherein the preferred orientation is 90 degrees from the expected orientation for which the screen was designed.

14. A point of sale terminal comprising:

a liquid crystal display screen for displaying information, the screen being installed in the point of sale terminal in an orientation rotated from an expected orientation for which the screen was designed;

a processor for assembling and formatting information into an information display for display by the screen; and display adjustment software executed by the processor for adjusting the information display to compensate for the orientation of the screen so that the information display is presented in a normal orientation;

wherein the screen is installed in an orientation which maximizes contrast of the information display for an orientation of the screen providing a desired ratio of horizontal and vertical dimensions.

* * * * *